US005658044A

United States Patent [19]

Krevh

[11] Patent Number: 5,658,044

[45] Date of Patent: Aug. 19, 1997

[54] INFANT CARRIER HANDLE

[75] Inventor: Maryann C. Krevh, Euclid, Ohio

[73] Assignee: Century Products Company, Macedonia, Ohio

[21] Appl. No.: 557,658

[22] Filed: Nov. 13, 1995

[51] Int. Cl.[6] ..... A47C 31/00

[52] U.S. Cl. ..... 297/183.6; 297/183.4; 297/183.1; 16/111 R

[58] Field of Search ..... 297/183.1, 183.2, 297/183.3, 183.4, 183.6; 16/111 R; 294/140

[56] References Cited

U.S. PATENT DOCUMENTS

| | | | |
|---|---|---|---|
| 3,857,604 | 12/1974 | Scott | 297/183.3 X |
| 5,207,476 | 5/1993 | Payne | 297/183.3 |
| 5,322,343 | 6/1994 | Parker et al. | 297/183.3 |
| 5,324,094 | 6/1994 | Kain | 297/183.1 |
| 5,409,292 | 4/1995 | Kain et al. | 297/183.3 X |

*Primary Examiner*—Peter M. Cuomo
*Assistant Examiner*—David E. Allred
*Attorney, Agent, or Firm*—Graham & James LLP

[57] ABSTRACT

An infant carrier with an improved handle having a generally bow or W shape and including first and second generally parallel leg portions each having a first end for attachment to the infant carrier and a second end, a central carrier portion including a central apex region flanked by a pair of nadir end regions, and a pair of arm cradle regions each having a first end joined to the second end of an associated leg portion and a second end joined to an associated nadir end region. The central carrier portion enables the user to grasp the carrier handle with either hand between the central apex region and the pair of nadir end regions, and the arm cradle regions enabling a user to cradle the handle in the crook of the arm.

10 Claims, 3 Drawing Sheets

INFANT CARRIER HANDLE

BACKGROUND OF THE INVENTION

This invention relates to infant carriers and more particularly to an improved handle for an infant carrier.

Infant carriers are known which generally comprise a body shell and a carrier handle pivotally attached to the shell for facilitating the transport of infants. Most carrier handles employed are generally U-shaped, or some variation of this shape, so that the handle may be grasped with either hand of the user for carrying purposes. Alternatively, the handle may be cradled in the crook of the user's arm. Representative examples of such infant carriers are disclosed in U.S. Pat. Nos. 4,634,175, 4,668,850 and 3,409,325.

While useful, such generally U-shaped carrier handles are ergonomically deficient in that prolonged use can lead to fatigue due to the awkward position of the hand. When cradled in the crook of the arm, the typical rounded or tubular shape of the handle can quickly result in user discomfort, usually leading to frequent shifting of the infant carrier from arm to arm, arm to hand, etc.

SUMMARY OF THE INVENTION

The invention comprises an infant carrier with an improved carrier handle which is ergonomically designed to make the carrying task more comfortable and which permits the transportation of the carrier with either or both hands or the crook of either arm with a minimum of discomfort.

In its broadest aspect, the invention comprises an infant carrier with an improved carrier handle comprising a base sized and adapted to receive an infant, and a carrier handle secured to the base, preferably by a pivotal and locking attachment. The carrier handle includes first and second generally parallel leg portions each having a first end for attachment to the base and a second end, a central carrier portion and a pair of arm cradle regions each having a first end joined to the second end of a different one of the first and second leg portions and a second end joined to the central carrier portion.

The central carrier portion has a generally bow or W-shape including a central apex region flanked by a pair of nadir end regions. The arm cradle regions each include a second end joined to a different one of the pair of nadir end regions.

The central carrier portion enables a user to grasp the carrier handle with one hand between the central apex region and one of the pair of nadir end regions, and to grasp the carrier handle with the other hand between the central apex region and the other one of the pair of nadir end regions. Each of the pair of arm cradle regions enables a user to cradle the handle in the crook of a different arm.

The central carrier portion preferably includes an outer cushion surface for additional hand comfort, the cushion surface preferably being a molded foam.

The arm cradle regions are provided with an angled bearing portion of greater width than the width of the central carrier portion to afford greater comfort to the user when the infant carrier is being carried by the crook of the arm.

The carrier handle is preferably made from a molded plastic material, such as polyethylene, polypropylene or some other suitable material.

For a fuller understanding of the nature and advantages of the invention, reference should be made to the ensuing detailed description, taken in conjunction with the accompanying drawings.

DETAILED DESCRIPTION OF THE PREFERRED EMBODIMENTS

Figure 1:
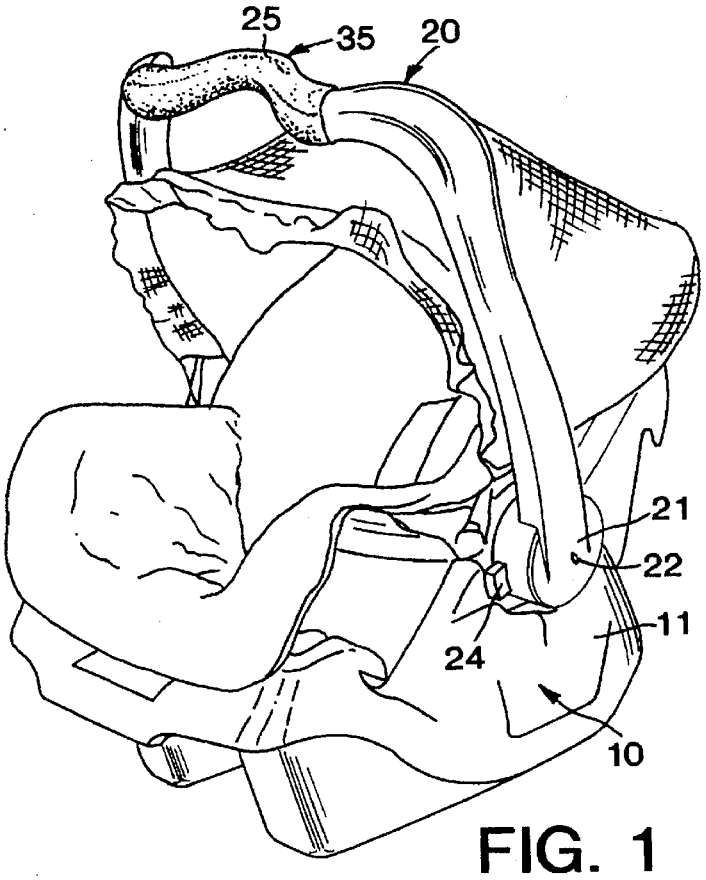
FIG. 1 is a perspective view of an infant carrier incorporating a preferred embodiment of the invention.
Figure 3:
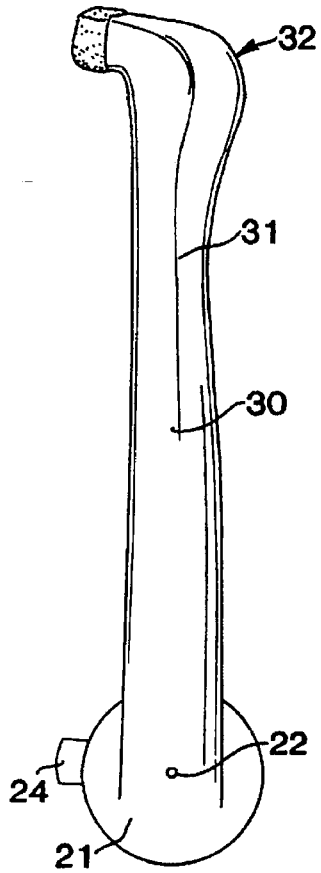
FIG. 3 is a right end view of the improved carrier handle.
Figure 2:
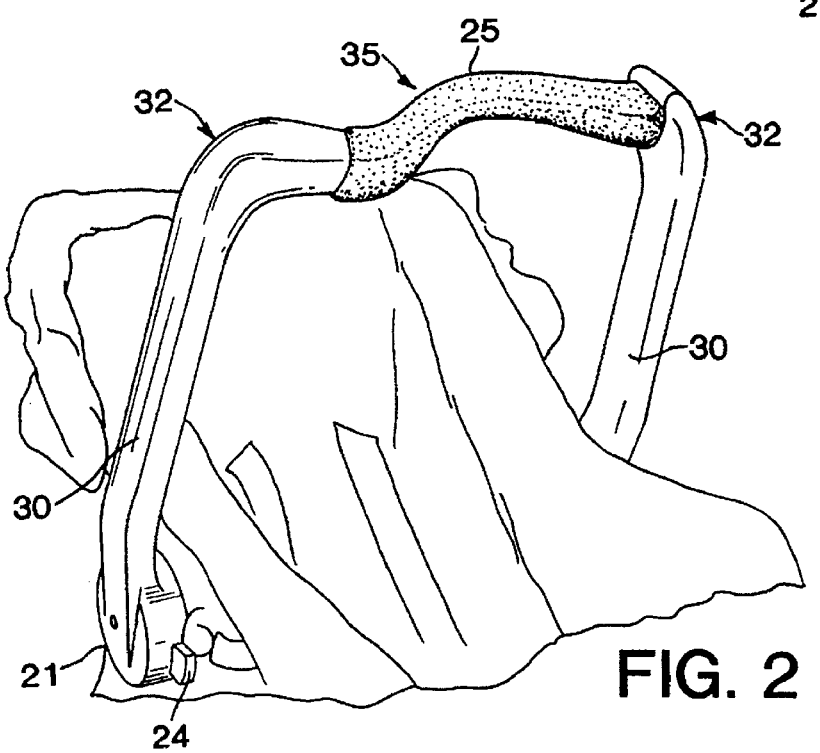
FIG. 2 is a partial perspective view taken from the left side of the carrier of FIG. 1.

Turning now to the drawings, FIG. 1 is a perspective view illustrating the preferred embodiment of the invention. As seen in this figure, an infant carrier comprises a base member generally designated with reference numeral 10 and a carrier handle generally designated with reference numeral 20. Base member 10 includes a pair of side walls 11 (only the rightmost wall being illustrated in the figure) to which the carrier handle 20 is pivotally attached by a suitable locking and pivoting mechanism incorporated within a first end 21 of the handle 20. The locking and pivoting mechanism may be any one of a number of suitable such mechanisms which enable the handle 20 to rotate about a pivot axis 22 and lock in place at different angular positions. There are many types of pivot joints well known in the art which are suitable for this purpose. One such device includes a locking ring and a button 24 which is outwardly biased by an inner spring (not shown). The interior of the locking ring is provided with gear teeth. When the button is depressed inwardly, the gear teeth are disengaged such that the handle 20 may pivot about the pivot axis 22. The pivot joint may be locked into place in any one of several angular orientations about axis 22.

Figure 4:
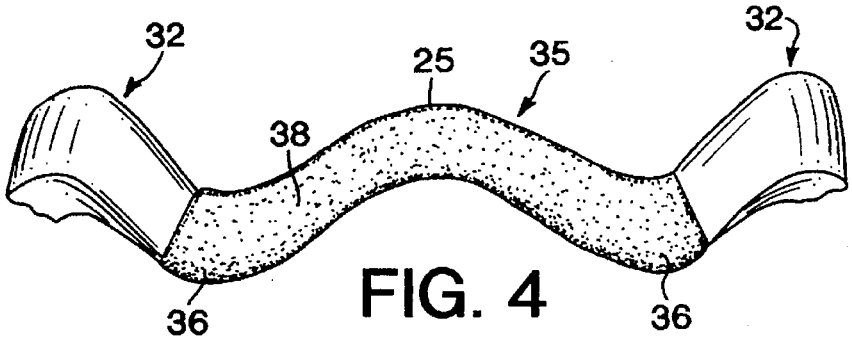
FIG. 4 is a view of the carrier handle looking in the direction of the leg portions.

Handle 20 is generally symmetric about the midpoint 25 and, as best seen in FIG. 4, has a shape resembling a bow or a W. Handle 20 includes a pair of leg portions 30 having pivot end 21 and an upper end 31 which blends into a cradle region generally designated with reference numeral 32. Each cradle region 32 blends into a central carrier portion generally designated with reference numeral 35 and having an apex at midpoint 25 which curves down and terminates in a pair of nadir end regions 36 located at the inner ends of the cradle regions 32. Central carrier portion 35 is provided with a cushion material 38 to cushion the hand when grasping the handle in this portion.

Handle 20 is preferably fabricated from molded plastic material, such as polyethylene or polypropylene; and cushion material 38 is preferably a molded foam.

Figure 5:
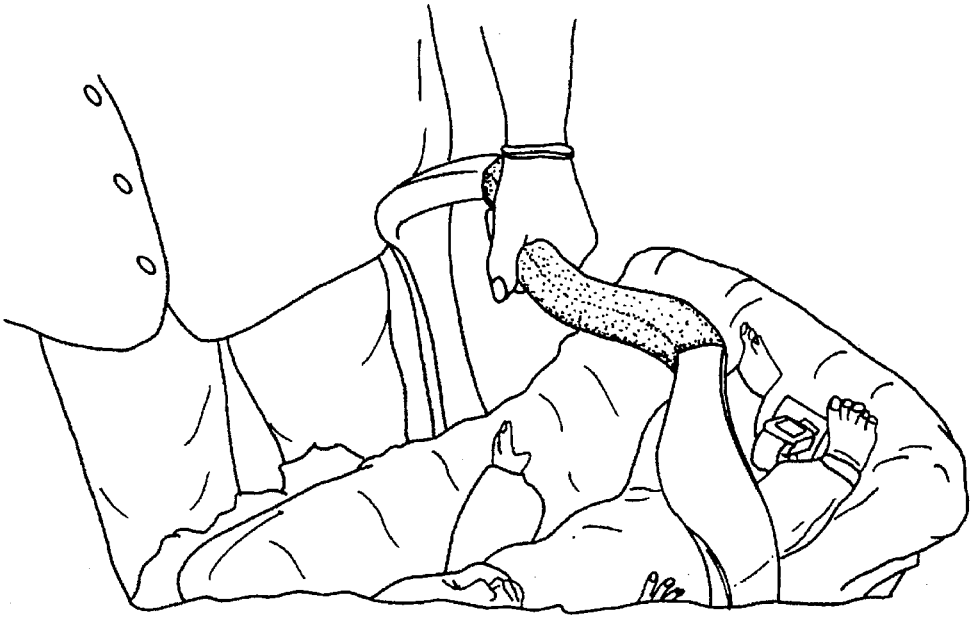
FIG. 5 is a partial perspective view illustrating single-handed use of the preferred embodiment.

FIG. 5 illustrates how the preferred embodiment is used when carrying an infant using the left hand. As seen in this figure, the left hand of the user grasps the central carrier region in the space between the apex at midpoint 25 and the left nadir end region 36. Due to the compound angle of the central carrier portion, the hand of the user is forcibly angled to a more natural position in which the inner surface of the wrist faces toward the body. As will be appreciated by those of ordinary skill in the art, the same effect is produced when the central carrier portion is grasped by the right hand of the user in the region between the midpoint 25 and the right nadir end region 36.

Figure 6:
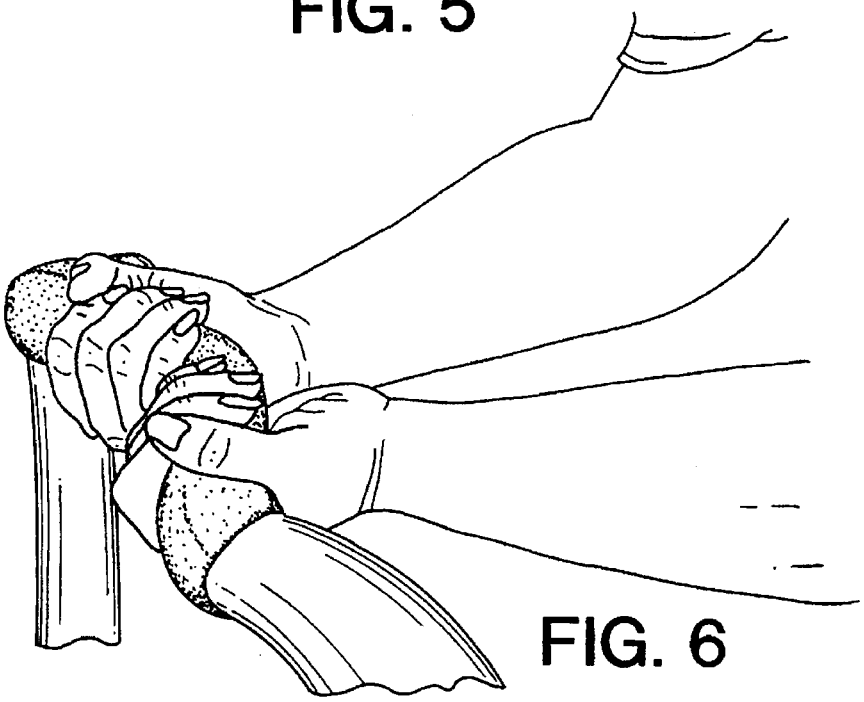
FIG. 6 is a partial perspective view illustrating double-handed use of the preferred embodiment.

FIG. 6 illustrates the position of both hands of the user when placed along the central carrier portion and used to lift or carry an infant. As seen in this figure, the right hand and the left hand are positioned in those regions of central carrier portion flanking the midpoint 25.

Figure 7:
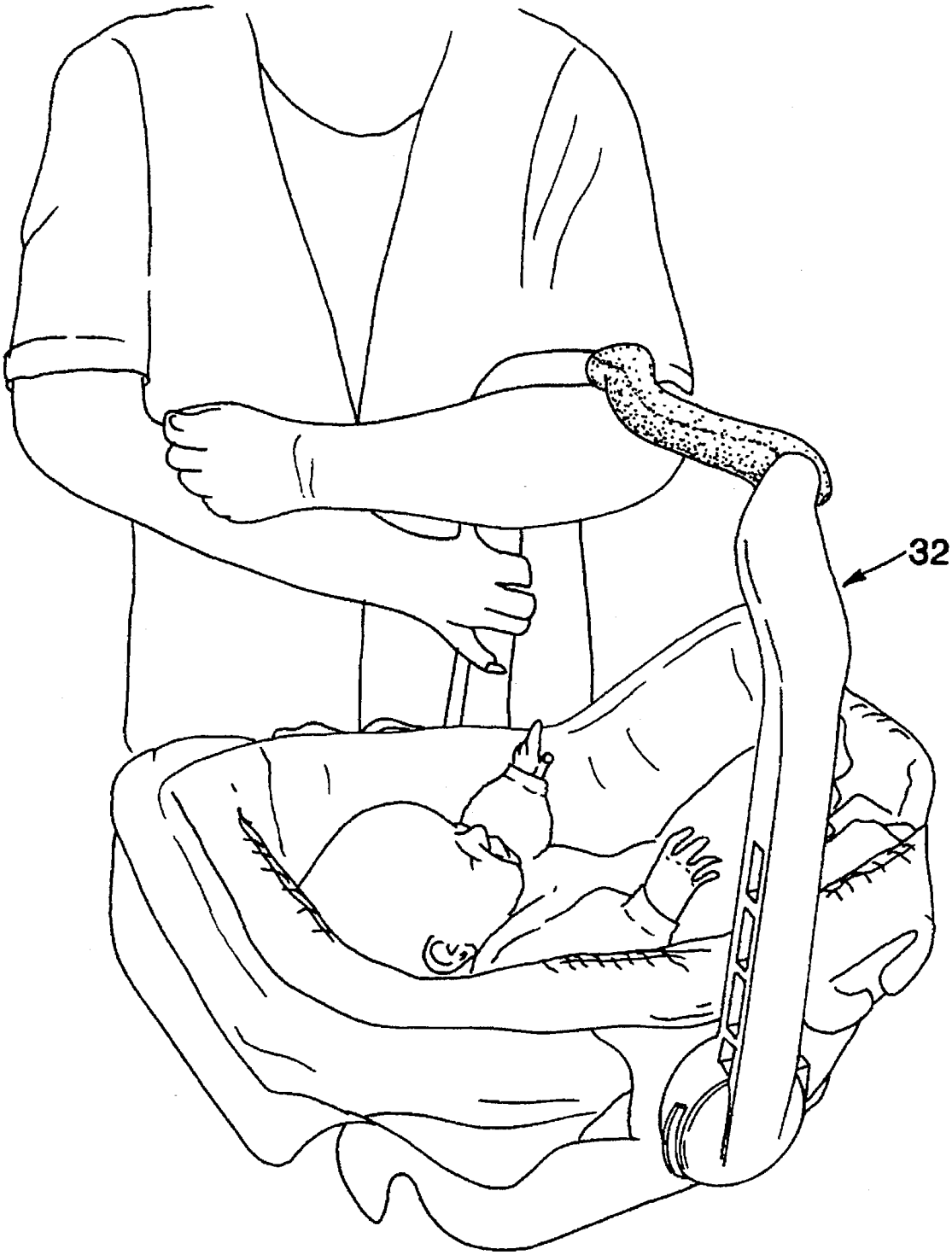
FIG. 7 is a partial perspective view illustrating use of the cradle region of the preferred embodiment.

FIG. 7 illustrates how the preferred embodiment may be carried by cradling the handle 20 in the crook of the left arm. As seen in this figure, the inside surface of the cradle region 32 is received in the crook of the arm. It is noted that the cradle region 32 has a wider contact surface than that of central carrier portion 35, and this wider contact surface distributes the pressure over a wider region of the crook of the user's arm, thereby ensuring less discomfort than prior art devices in which the handle portion at the U-bend has substantially the same diameter as the central handle portion.

As will now be apparent, the invention provides several different modes of carrying an infant carrier with one or both hands or the crook of the user's arm, and is ergonomically designed to lessen the discomfort and fatigue normally encountered in the use of infant carriers.

While the above provides a full and complete disclosure of the preferred embodiments of the invention, various modifications, alternate constructions and equivalents may be employed, as desired. Therefore, the above description and illustrations should not be construed as limiting the scope of the invention, which is defined by the appended claims.

What is claimed is:

1. An improved carrier handle for an infant carrier comprising:

first and second generally parallel leg portions each having a first end for attachment to an infant carrier and a second end defining a length;

a central carrier portion having a generally W-shaped configuration as viewed in a direction substantially parallel to said length of said leg portions, said central carrier portion including a central apex region flanked by a pair of nadir end regions; and a pair of arm cradle regions each having a first end joined to the second end of a different one of said first and second leg portions and a second end joined to a different one of said pair of nadir end regions, each arm cradle region having an arm cradle portion broader than the second end of the associated leg portion and broader than the joined nadir end portion of the central carrier portion, said central carrier portion enabling a user to grasp the carrier handle with one hand between the central apex region and one of the pair of nadir end regions and with the other hand between the central apex region and the other one of the pair of nadir end regions, each of said pair of arm cradle regions enabling a user to cradle the handle in the crook of a different arm.

2. The invention of claim 1 wherein said central carrier portion includes an outer cushion surface.

3. The invention of claim 2 wherein said outer cushion surface is a molded foam material.

4. The invention of claim 1 wherein said arm cradle regions have an angled bearing portion of greater width than the width of said central carrier portion.

5. The invention of claim 1 wherein said first end of each of said first and second leg portions includes a pivot mechanism for enabling attachment of said carrier handle to an infant carrier.

6. The invention of claim 1 wherein said carrier handle is made from a plastic material.

7. The invention of claim 6 wherein said plastic material is polyethylene.

8. The invention of claim 6 wherein said plastic material is polypropylene.

9. The invention of claim 1 further including an infant carrier sized and adapted to receive an infant, said carrier handle being secured to said infant carrier.

10. The invention of claim 9 wherein said carrier handle is secured to said infant carrier at the first end of each of said first and second leg portions.

* * * * *